US009418648B1

(12) United States Patent
Tankhilevich

(10) Patent No.: US 9,418,648 B1
(45) Date of Patent: Aug. 16, 2016

(54) EFFECTIVE GENERATION OF ULTRA-HIGH FREQUENCY SOUND IN CONDUCTIVE FERROMAGNETIC MATERIAL

(71) Applicant: Boris G. Tankhilevich, Walnut Creek, CA (US)

(72) Inventor: Boris G. Tankhilevich, Walnut Creek, CA (US)

( * ) Notice: Subject to any disclaimer, the term of this patent is extended or adjusted under 35 U.S.C. 154(b) by 0 days.

(21) Appl. No.: 14/827,273

(22) Filed: Aug. 15, 2015

Related U.S. Application Data

(63) Continuation-in-part of application No. 14/517,801, filed on Oct. 18, 2014, now Pat. No. 9,132,451.

(51) Int. Cl.
*G10K 11/00* (2006.01)
*G10K 11/18* (2006.01)

(52) U.S. Cl.
CPC ..... *G10K 11/18* (2013.01)

(58) Field of Classification Search
CPC ..... G10K 11/18; B06B 1/04
See application file for complete search history.

(56) References Cited

U.S. PATENT DOCUMENTS 7,411,445 B2 8/2008 Kucherov et al.
7,430,074 B2 9/2008 Korenblit et al.
7,507,302 B2 3/2009 Miyoshi et al.
7,508,578 B2 3/2009 Korenblit et al.
7,649,679 B2 1/2010 Ajiki et al.
7,986,454 B1 7/2011 Korenblit et al.
2010/0019798 A1 1/2010 Saito et al.
2011/0101250 A1 5/2011 Hu
2014/0119161 A1 5/2014 Tankhilevich et al.

OTHER PUBLICATIONS

Coey et al. "Half-metallic ferromagnetism: Example of CrO2", Journal of Applied Physics, vol. 91, No. 10, pp. 8345-8350, May 2002.
Shan et al. "Demonstration of Half-Metallicity in Fermi-Level-Tuned Heusler Alloy CO2FeAl0.5Si0.5 at Room Temperature", Physical Review Letters 102, 246601, Jun. 19, 2009.
Korenblit et al. "Generation of High-Frequency Magnons by NonEquilibrium Electrons Polarized Opposite to the Direction of Magnetization", Soviet Physics, JETP, vol. 46(6), pp. 1167-1175, Dec. 1977.

(Continued)

*Primary Examiner* — Luke Ratcliffe
*Assistant Examiner* — Hovhannes Baghdasaryan
(74) *Attorney, Agent, or Firm* — Boris G. Tankhilevich

(57) ABSTRACT

An apparatus for generation of an ultra-high frequency sound waves with frequencies between (1 GHz-10 GHz) is proposed. The apparatus comprises a spin injector, a tunnel junction, a conductive ferromagnetic material including magnon gain medium, a ferromagnetic dielectric material including magnetic phonon-gain medium, and an ultra-high frequency sound waveguide coupled to the ferromagnetic dielectric material. The spin injector is configured to inject minority non-equilibrium elections into the conductive ferromagnetic material via the tunnel junction. The non-equilibrium magnons generated in the magnon gain medium of the conductive ferromagnetic material propagate into the ferromagnetic dielectric material and having the magnon velocity exceeding the sound velocity in the phonon-gain medium of the ferromagnetic dielectric material cause generation of ultra-high frequency non-equilibrium phonons in the ferromagnetic dielectric material. The ultra-high frequency sound waveguide is configured to output the ultra-high frequency sound generated in the ferromagnetic dielectric material.

20 Claims, 1 Drawing Sheet

(56) References Cited

OTHER PUBLICATIONS

Korenblit et al. "Generation of High-Frequency Magnons in a Ferromagnetic Semiconductor", Pis'ma Zh. Eksp. Teor. Fiz. 24, No. 11, pp. 598-601, Dec. 1976.
Korenblit et al. "High Frequency Magnon Generation by NonEquilibrium Electrons and the Instability of the Magnon System", Physics Letters, vol. 64A, No. 3, pp. 307-308, Dec. 1977.
Akhiezer et al. "Spin Waves", North-Holland Series in Low Temperature Physics, vol. 1, pp. 268-275, 1968.
Wurmehl et al. "Geometric, electric, and magnetic structure of Co2FeSi: Curie temperature and magnetic moment measurements and calculations", Physical Review B 72, 184434, 2005.
Kittel "Quantum Theory of Solids", John Wiley & Sons, Inc., 1963.
Swartz "Thermal boundary resistance", Reviews of Modern Physics, vol. 61, No. 3, pp. 605-668, Jul. 1989.
Hiroaki Sukegawa et al., "Spin-transfer switching in full-Heusler Co2FeAl-based magnetic tunnel junctions", Applied Physics Letters, vol. 100, 182403, Apr. 2012.
U.S. Appl. No. 13/661,053: Notice of Allowance and Fee(s) Due dated Oct. 22, 2014.
U.S. Appl. No. 14/517,801: Notice of Allowance and Fee(s) Due dated May 13, 2015.

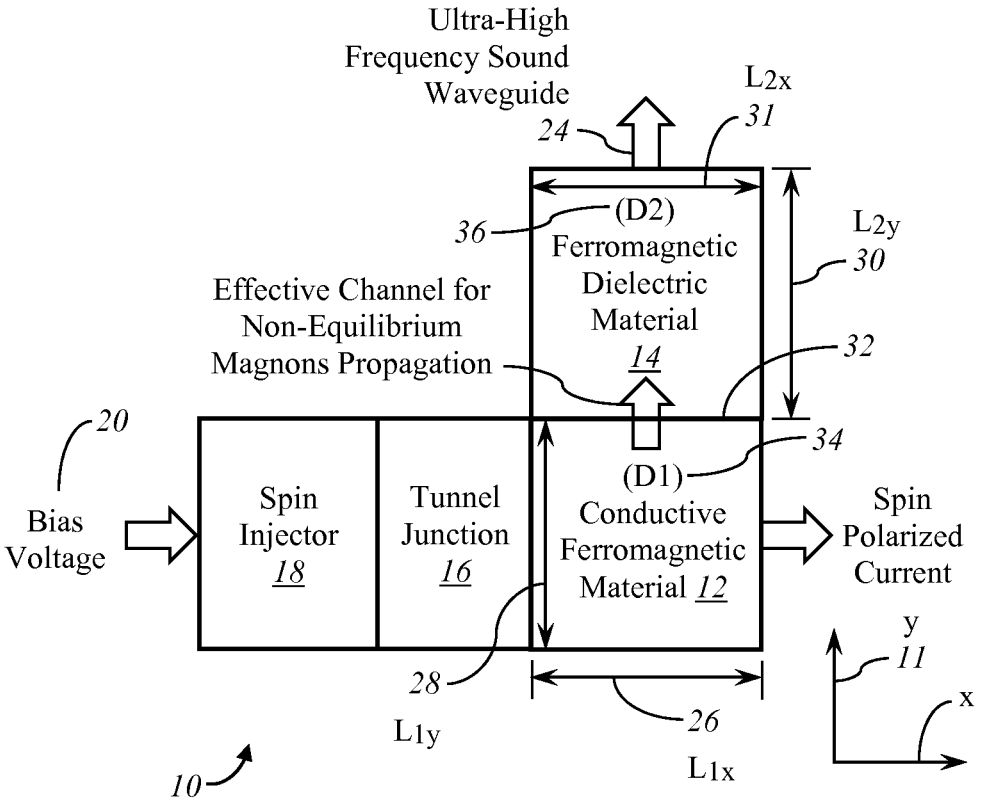
Ultra-High
Frequency Sound
Waveguide
24
L2x
31
36
(D2)
Ferromagnetic
Dielectric
Material
14
L2y
30
Effective Channel for
Non-Equilibrium
Magnons Propagation
32
20
34
(D1)
Bias
Voltage
Spin
Injector
18
Tunnel
Junction
16
Conductive
Ferromagnetic
Material 12
Spin
Polarized
Current
y
11
x
28
L1y
26
L1x
10

EFFECTIVE GENERATION OF ULTRA-HIGH FREQUENCY SOUND IN CONDUCTIVE FERROMAGNETIC MATERIAL

REFERENCE TO RELATED APPLICATIONS

This is the continuation-in-part of the U.S. patent application Ser. No. 14/517,801, filed on Oct. 18, 2014 and entitled "USING TUNNEL JUNCTION AND BIAS FOR EFFECTIVE CURRENT INJECTION INTO MAGNETIC PHONON-GAIN MEDIUM", which is the continuation-in-part application for the U.S. patent application Ser. No. 13/661,053, filed on Oct. 26, 2012, and entitled "GENERATION OF ULTRA-HIGH FREQUENCY SOUND", now U.S. Pat. No. 8,891,335.

TECHNICAL FIELD

The technology relates to the generation of ultra-high frequency sound in the GHz region.

BACKGROUND

In the parent U.S. patent application Ser. No. 13/661,053, filed on Oct. 26, 2012, and entitled "GENERATION OF ULTRA-HIGH FREQUENCY SOUND", (now U.S. Pat. No. 8,891,335) the generation of ultra-high frequency (1-10) GHz sound was disclosed. In the U.S. patent application Ser. No. 14/517,801, filed on Oct. 18, 2014 and entitled "USING TUNNEL JUNCTION AND BIAS FOR EFFECTIVE CURRENT INJECTION INTO MAGNETIC PHONON-GAIN MEDIUM" an efficient technique for injection of electrical current into sub-band having spin opposite to the direction of magnetization of the conductive ferromagnetic material was disclosed.

SUMMARY

This Summary is provided to introduce a selection of concepts that are further described below in the Detailed Description. This Summary is not intended to identify key or essential features of the claimed subject matter, nor is it intended to be used as an aid in determining the scope of the claimed subject matter.

An apparatus for generation of an ultra-high frequency sound waves with frequencies between (1 GHz-10 GHz) is proposed.

The apparatus of the present technology comprises a spin injector coupled to a tunnel junction. The tunnel junction is coupled to a conductive ferromagnetic material including magnon gain medium. The spin injector is configured to inject minority non-equilibrium electrons into the conductive ferromagnetic material via the tunnel junction. The non-equilibrium magnons are generated in the magnon gain medium of the conductive ferromagnetic material.

The apparatus of the present technology further comprises a ferromagnetic dielectric material coupled to the conductive ferromagnetic material. The ferromagnetic dielectric material includes the magnetic phonon-gain medium. The non-equilibrium magnons propagated into the ferromagnetic dielectric material and having the magnon velocity exceeding the sound velocity in the phonon-gain medium of the ferromagnetic dielectric material cause generation of ultra-high frequency non-equilibrium phonons in the ferromagnetic dielectric material.

The apparatus of the present technology further comprises an ultra-high frequency sound waveguide coupled to the ferromagnetic dielectric material. The ultra-high frequency sound waveguide is configured to output the ultra-high frequency sound generated in the ferromagnetic dielectric material.

DESCRIPTION OF THE DRAWINGS

The accompanying drawings, which are incorporated in and form a part of this specification, illustrate embodiments of the technology and, together with the description, serve to explain the principles below:

FIG. 1 depicts a block diagram of the apparatus of the present technology comprising a spin injector, a tunnel junction, a conductive ferromagnetic material, a ferromagnetic dielectric material, and an ultra-high Frequency Sound Waveguide configured to output the non-equilibrium high frequency phonons having frequency in the range of (1-10) GHz.

DETAILED DESCRIPTION

Reference now is made in detail to the embodiments of the technology, examples of which are illustrated in the accompanying drawings. While the present technology will be described in conjunction with the various embodiments, it will be understood that they are not intended to limit the present technology to these embodiments. On the contrary, the present technology is intended to cover alternatives, modifications and equivalents, which may be included within the spirit and scope of the various embodiments as defined by the appended claims.

Furthermore, in the following detailed description, numerous specific-details are set forth in order to provide a thorough understanding of the presented embodiments. However, it will be obvious to one of ordinary skill in the art that the presented embodiments may be practiced without these specific details. In other instances, well known methods, procedures, components, and circuits have not been described in detail as not to unnecessarily obscure aspects of the presented embodiments.

In an embodiment of the present technology, FIG. 1 depicts a block diagram 10 of the apparatus comprising a spin injector 18, a tunnel junction 16, a conductive ferromagnetic material 12, and a ferromagnetic dielectric material 14 further including a magnetic phonon-gain medium (not shown). A bias voltage 20 is applied to the spin injector 18.

The Ultra-High Frequency Sound Waveguide 24 is configured to output the non-equilibrium high frequency phonons having frequency in the range of (1-10) GHz.

The Ultra-High Frequency Sound Waveguide 24 can be implemented by using an ultrasonic horn. Ultrasonic horn (also known as acoustic horn, sonotrode, acoustic waveguide, ultrasonic probe) is necessary because the amplitudes provided by the transducers themselves are insufficient for most practical applications of power ultrasound. Another function of the ultrasonic horn is to efficiently transfer the acoustic energy from the ultrasonic transducer into the treated media, which may be solid (for example, in ultrasonic welding, ultrasonic cutting or ultrasonic soldering) or liquid (for example, in ultrasonic homogenization, sonochemistry, milling, emulsification, spraying or cell disruption).

Ultrasonic processing of liquids relies of intense shear forces and extreme local conditions (temperatures up to 5000 K and pressures up to 1000 atm) generated by acoustic cavitation. The ultrasonic horn is commonly a solid metal rod with a round transverse cross-section and a variable-shape longitudinal cross-section—the rod horn. Another group includes the block horn, which has a large rectangular transverse cross-section and a variable-shape longitudinal cross-section, and more complex composite horns. The devices from this group are used with solid treated media. The length of the device must be such that there is mechanical resonance at the desired ultrasonic frequency of operation—one or multiple half wavelengths of ultrasound in the horn material, with sound speed dependence on the horn's cross-section taken into account. In a common assembly, the ultrasonic horn is rigidly connected to the ultrasonic transducer using a threaded stud.

In an embodiment of the present technology, as was shown in the parent case U.S. Pat. No. 8,891,335 (that is incorporated herein in its entirety), the conductive ferromagnetic material 12 comprise a conduction band (not shown) that is split into two sub-bands separated by an exchange energy gap, a first sub-band having spin up, and a second sub-band having spin down.

In an embodiment of the present technology, as was shown in the U.S. patent application Ser. No. 14/517,801, filed on Oct. 18, 2014 and entitled "USING TUNNEL JUNCTION AND BIAS FOR EFFECTIVE CURRENT INJECTION INTO MAGNETIC PHONON-GAIN MEDIUM" (the U.S. patent application Ser. No. 14/517,801 is incorporated herein in its entirety), the application of the bias voltage 20 is used to shift the Fermi level of the spin injector 18 with respect to the Fermi level of the conductive ferromagnetic material 12 so that the injected electrons tunneling via the tunnel junction 16 into the second sub-band of the conductive ferromagnetic material 12 having spin down, flip their spin, pass into the first sub-band having spin up, and generate non-equilibrium magnons during this process.

In an embodiment of the present technology, the conductive ferromagnetic material (12 of FIG. 1) is selected from the group consisting of: a ferromagnetic semiconductor; a dilute magnetic semiconductor (DMS); a half-metallic ferromagnet (HMF); and a ferromagnetic conductor, with a gap in the density of states of the minority electrons around the Fermi energy.

Recently some dilute magnetic semiconductors (DMS), with Tc above room temperature, have been studied intensively. These are oxides doped with magnetic cations. The examples are: GaN, doping Mn-9%, Tc=940 K; AlN, doping Cr-7%, Tc>600 K; TiO2 (anatase), doping Co-7%, Tc=650 K; SnO2, doping Co-5%, Tc=650 K. These magnets can be used as a magnon gain medium (MGM) to generate nonequilibrium magnons and photons at room temperatures.

In an embodiment of the present technology, the half-metallic ferromagnet (HMF) is selected from the group consisting of a spin-polarized Heusler alloy; a spin-polarized Colossal magnetoresistance material; and CrO2.

Half-metallic ferromagnets (HMF) are ferromagnetic conductors, with a gap in the density of states of the minority electrons around the Fermi energy, Ef. Thus, the electrons in these materials are supposed to be 100% spin polarized at Ef. Thermal effects and spin-orbital interactions reduce the electron polarization. However, the electron polarization is close to 100% in half-metallic ferromagnets with spin-orbital interaction smaller than the minority electron gap and at temperatures much lower than the Curie temperature Tc.

Half-metallic ferromagnets (HMF) form a quite diverse collection of materials with very different chemical and physical properties.

Chromium Dioxide, $CrO_2$.

Tc=390 K. Magnetic moment per Cr=2 μB. The polarization measured at low temperatures is close to 100%. There are some other known half-metallic ferromagnetic oxides, e.g. $Sr_2FeMoO_6$.

Heusler Alloys.

Most of the predicted HMF is Heusler alloys. In general, these are ternary X2YZ-compounds, X and Y are usually transition metals and Z is a main group element. The most studied of them is NiMnSb: Tc=728 K, with magnetic moment close to 4 μB. Experiments show that NiMnSb is a half-metallic ferromagnet at low temperatures. But there is evidence that at T≈90 K a phase transition into a usual ferromagnetic state takes place, and it seems unlikely that NiMnSb is a half-metallic ferromagnet near room temperature.

There are many other Heusler alloys with half-metallic ferromagnet properties, like: (1) $Co_2MnSi$ (CMS) having Tc of 1034 K and magnetic moment of 5 μB; (2) $Co_2MnGe$ having Tc of 905 K and magnetic moment close to 5 μB; and (3) $Co_2MnSn$ having Tc of 826 K and magnetic moment of 5.4 μB; etc.

Colossal Magnetoresistance Materials:

$La_{1-x}Sr_xMnO_3$ (for intermediate values of x) is presumably a half-metallic ferromagnet having Tc close to room temperature. Photoelectron emission experiments confirm the half-metallicity of $La_{0.7}Sr_{0.3}MnO_3$, with Tc=350 K. The polarization degree at T=40K is 100±5%, the gap for the minority spins is 1.2 eV.

In an embodiment of the present technology, the spin-polarized Heusler alloy is selected from the group consisting of $Co_2FeAl_{0.5}Si_{0.5}$; NiMnSb; $Co_2MnSi$ (CMS); $Co_2MnGe$; $Co_2MnSn$; $Co_2FeAl$ and $Co_2FeS$ (CFS).

It has been shown recently (S. Wurmehl et al., *PRB* 72, 184434 (2005)), that the alloy with the highest magnetic moment and Tc is $Co_2FeSi$ having Tc of 1100 K (higher than for Fe), and having magnetic moment per unit cell of 6 μB. The orbital contribution to the moments is small, while the exchange gap is large, of order 2 eV. Therefore, the effect of thermal fluctuations and spin-orbit interaction on the electron polarization is negligible. One should expect, therefore, that the electrons in $Co_2FeSi$ (CFS) are polarized at high temperatures, sufficiently close to Tc. Indeed, according to the experiment the magnetic moment at 300 K is the same as at 5 K.

Note that HMF, as well as ferromagnetic semiconductors, differ from "normal" metallic ferromagnets by the absence of one-magnon scattering processes. Therefore, spin waves in HMF, as well as in magnetic insulators, are well defined in the entire Brillouin zone. This was confirmed by neutron scattering experiments performed on some Heusler alloys. For references, please see: (1) Y. Noda and Y. Ishikawa (*J. Phys. Soc. Japan v.* 40, 690, 699 (1976)) have investigated the following Heusler alloys: $Pd_2MnSn$ and $Ni_2MnSn$; (2) K. Tajima et al. (*J. Phys. Soc. Jap. v.* 43, 483 (1977)), have investigated Heusler alloy $Cu_2MnAl$.

However, in the present application, the above disclosed magnets are used as a magnon gain medium to generate the non-equilibrium magnons. Please, see the discussion below.

In an embodiment of the present technology, referring still to FIG. 1, the spin injector 18 comprises a half-metal (please, see discussion above) having magnetization oriented antiparallel to the magnetization of the conductive ferromagnetic material 12. The antiparallel orientation of the magnetization of the spin injector relatively to the orientation of the magnetization of the conductive ferromagnetic material can be achieved by using antiferromagnetic pinning layers (not shown) having an exchange bias effect on the spin injector and "pinning" its soft magnetization in one selected direction.

Exchange bias (or exchange anisotropy) occurs in bilayers (or multilayers) of magnetic materials where the hard magnetization behavior of an antiferromagnetic thin film causes a shift in the soft magnetization curve of a ferromagnetic film. The exchange bias phenomenon is of tremendous utility in magnetic recording, where it is used to pin the state of the read back heads of hard disk drives at exactly their point of maximum sensitivity; hence the term "bias."

Currently exchange bias is used to pin the harder reference layer in spin valve read back heads and MRAM memory circuits that utilize the giant magnetoresistance or magnetic tunneling effect. Desirable properties for an exchange bias material include a high Néel temperature, a large magnetocrystalline anisotropy and good chemical and structural compatibility with NiFe and Co, the most important ferromagnetic films. The most technologically significant exchange bias materials have been the rock salt-structure antiferromagnetic oxides like NiO, CoO and their alloys and the rock salt-structure intermetallics like FeMn, NiMn, IrMn and their alloys.

In an embodiment of the present technology, referring still to FIG. 1, the tunnel junction 16 is selected from the group consisting of a thin insulating layer between the spin injector 18 and the conductive ferromagnetic material 12. The tunnel junction is selected from the group consisting of: AlO; $Al_2O_3$ and MgO.

The current densities of $10^7$ A/cm$^2$ (well above the critical pumping currents of order of ($10^5$-$10^6$) A/cm$^2$ that we need) were achieved by using very thin MgO tunnel junctions. For reference, please see: "*Spin-transfer switching in full-Heusler $Co_2FeAl$-based magnetic tunnel junctions*;" by Hiroaki Sukegawa, Zhenchao Wen, Kouta Kondou, Shinya Kasai, Seiji Mitani, and Koichiro Inomata, *Applied Physics Letters,* 100, 182403 (2012). Thus, applying the threshold current density for achieving the magnon lasing threshold is feasible in the proposed apparatus 10 of FIG. 1.

In an embodiment of the present technology, because the tunnel junction 16 separates electronic systems of the conductive ferromagnetic material 12 and of the electronic system of spin injector 18, the external bias voltage 20 can be applied to the spin injector 18 to shift its Fermi level with respect to the Fermi level of the conductive ferromagnetic material 12.

In an embodiment of the present technology, as was shown in the parent cases (the U.S. Pat. No. 8,891,335, and the U.S. patent application Ser. No. 14/517,801), the electrons injected into the conductive ferromagnetic material 12 via tunnel junction 16 are tunneling into the upper sub-band with spin down, flip their spin and emit magnons by entering the sub-band with spin up, thus generating non-equilibrium magnons inside the conductive ferromagnetic material 12.

In an embodiment of the present technology, however, the process of generation of ultra-high frequency sound waves with frequencies between (1 GHz-10 GHz) in the conductive ferromagnetic material 12 by using the non-equilibrium magnons having magnon velocity higher than speed of sound u, is suppressed by selecting the dimensions of the conductive ferromagnetic material $L_{1x}$ 26 and $L_{1y}$ 28 both below critical:

$$L_{1x} \leq Lc \approx (10^{-2}-10^{-3})\ \text{cm}, \quad \text{(Eq. 1)}$$

$$L_{1y} \leq Lc \approx (10^{-2}-10^{-3})\ \text{cm}, \quad \text{(Eq. 2)}$$

so that phonon instability relation is not satisfied within the geometrical region ($L_{1x}$, $L_{1y}$) of the conductive ferromagnetic material 12.

In an embodiment of the present technology, however the instability relationship is satisfied in the ferromagnetic dielectric material 14 by selecting its dimension $L_{2y}$ 30 above critical:

$$L_{2y} \geq Lc \approx (10^{-2}-10^{-3})\ \text{cm}, \quad \text{(Eq. 3)}$$

but $L_{2x}$ 31 below critical $$L_{2x} \leq Lc \approx (10^{-2}-10^{-3})\ \text{cm}, \quad \text{(Eq. 4)}$$

so that the ultra-high frequency sound will be generated only along the axis y 11 and will be outputted by the ultra-high frequency waveguide 24 also in the y direction.

Indeed, the main source of phonon damping in half-metals is phonon-electron scattering. That is why to achieve the effective generation of ultra-high frequency sound we should provide the instability region inside the ferromagnetic dielectric material 14 (that has no free electrons). Thus, the effective generation of ultra-high frequency sound inside the ferromagnetic dielectric material 14 means that that the generated ultra-frequency sound will experience low damping inside the ferromagnetic dielectric material 14.

A non-equilibrium magnon generated in the conductive ferromagnetic material 12 including the magnon-gain medium has an exchange energy that is far greater than the relativistic energy with which the non-equilibrium magnon interacts at the border area 32 between the conductive ferromagnetic material 12 and the ferromagnetic dielectric material 14. That is why the non-equilibrium magnon interacts at the border area 32 can either propagate into the ferromagnetic dielectric material 14 with the probability P or reflect back into the in the conductive ferromagnetic material 12 with the probability R. This is the classic description.

However, the non-equilibrium magnon having an exchange energy that is far greater than the relativistic energy is substantially a quantum object. That is why the non-equilibrium magnon having an exchange energy that is far greater than the relativistic energy can at the same time do both:

(i) propagate into the ferromagnetic dielectric material 14 with the probability P;

and (ii) reflect back into the conductive ferromagnetic material 12 with the probability R.

But, the sum of P and R should be 1:

$$P+R=1. \quad \text{(Eq. 5)}$$

The coefficients P and R depend on both the magnon stiffness $D_1$ 34 inside the conductive ferromagnetic material 12 and the magnon stiffness $D_2$ 36 inside the ferromagnetic dielectric material 14. Typically, the value of magnon stiffness correlates with the temperature Curie of the material: the greater the temperature Curie the greater the stiffness D.

For a typical ferromagnetic dielectric material 14 let us take Yttrium iron garnet (YIG). Indeed, YIG is a kind of synthetic garnet, with chemical composition $\underline{Y_3}\underline{Fe_2}(Fe\underline{O_4})_3$, or $Y_3Fe_5O_{12}$. It is a ferrimagnetic material with a temperature Curie of 560 K. YIG may also be known as Yttrium ferrite garnet, or as Iron yttrium oxide or Yttrium iron oxide, the latter two names usually associated with powdered forms.

For a typical conductive ferromagnetic material let us take a half-metal CMS having a temperature Curie temperature Curie of 1034 K.

Thus, we assume that the magnon stiffness $D_1$ inside the conductive ferromagnetic material 12 is greater than the magnon stiffness $D_2$ inside the ferromagnetic dielectric material. If this is the case, we have the following:

$$P \approx D_2/D_1; \quad \text{(Eq. 6)}$$

and:

$$R \approx 1 - D_2/D_1, \quad \text{(Eq. 7)}$$

so that P+R=1.

If $D_2$ is zero, than the ferromagnetic dielectric material 14 is a non-magnetic material with temperature Curie equal to zero as well, and P is also zero as magnons cannot propagate into the non-magnetic material.

Thus, only a part $P \approx D_2/D_1$ of non-equilibrium magnons takes part in the process of Cherenkov-type generation of non-equilibrium phonons having ultra-high frequency in the ferromagnetic dielectric material 14. But the non-equilibrium phonons having ultra-high frequency generated in the ferromagnetic dielectric material 14 do not damp on free electrons (which is the main source of damping of non-equilibrium phonons having ultra-high frequency) because free electrons do not exist inside the ferromagnetic dielectric material 14. That is why the generation of the ultra-high frequency sound is much more effective in the apparatus of the present technology as opposed to the apparatus disclosed in the parent U.S. Pat. No. 8,891,335.

The above discussion has set forth the operation of various exemplary systems and devices, as well as various embodiments pertaining to exemplary methods of operating such systems and devices. In various embodiments, one or more steps of a method of implementation are carried out by a processor under the control of computer-readable and computer-executable instructions. Thus, in some embodiments, these methods are implemented via a computer.

In an embodiment, the computer-readable and computer-executable instructions may reside on computer useable/readable media.

Therefore, one or more operations of various embodiments may be controlled or implemented using computer-executable instructions, such as program modules, being executed by a computer. Generally, program modules include routines, programs, objects, components, data structures, etc., that perform particular tasks or implement particular abstract data types. In addition, the present technology may also be practiced in distributed computing environments where tasks are performed by remote processing devices that are linked through a communications network. In a distributed computing environment, program modules may be located in both local and remote computer-storage media including memory-storage devices. The present technology may also be implemented in a real time, or in a post-processed, or a time-shifted implementation where sufficient data is recorded to permit calculation of final results at a later time.

Although specific steps of exemplary methods of implementation are disclosed herein, these steps are examples of steps that may be performed in accordance with various exemplary embodiments. That is, embodiments disclosed herein are well suited to performing various other steps or variations of the steps recited. Moreover, the steps disclosed herein may be performed in an order different than presented, and not all of the steps are necessarily performed in a particular embodiment.

Although various electronic and software based systems are discussed herein, these systems are merely examples of environments that might be utilized, and are not intended to suggest any limitation as to the scope of use or functionality of the present technology. Neither should such systems be interpreted as having any dependency or relation to any one or combination of components or functions illustrated in the disclosed examples.

Although the subject matter has been described in a language specific to structural features and/or methodological acts, the subject matter defined in the appended claims is not necessarily limited to the specific features or acts described above. Rather, the specific features and acts described above are disclosed as exemplary forms of implementing the claims.

What is claimed is:

1. An apparatus for generating an ultra-high frequency sound comprising:

a spin injector; said spin injector comprising a source of minority electrons;

a tunnel junction coupled to said spin injector;

a conductive ferromagnetic material coupled to said tunnel junction; said conductive ferromagnetic material including a magnon gain medium; wherein said minority electrons tunneling into said magnon gain medium via said tunnel junction generate non-equilibrium magnons inside said magnon gain medium;

and a ferromagnetic dielectric material coupled to said conductive ferromagnetic material; said ferromagnetic dielectric material including a magnetic phonon-gain medium; wherein said non-equilibrium magnons propagating into said magnetic phonon-gain medium from said conductive ferromagnetic material generate ultra-high frequency phonons inside said magnetic phonon-gain medium.

2. The apparatus of claim 1, wherein said spin injector is selected from the group consisting of:

a half-metal having lower sub-band with spin down oriented opposite to the direction of magnetization of said conductive ferromagnetic material; and a half-metal having lower sub-band with spin down oriented opposite to the direction of magnetization of said conductive ferromagnetic material by applying an external force.

3. The apparatus of claim 1, wherein said conductive ferromagnetic material including said magnon gain medium is selected from the group consisting of:

a ferromagnetic semiconductor; a dilute magnetic semiconductor (DMS); a half-metallic ferromagnet (HMF); and a ferromagnetic conductor, with a gap in the density of states of the minority electrons around the Fermi level of said conductive ferromagnetic material.

4. The apparatus of claim 3, wherein said half-metallic ferromagnet (HMF) is selected from the group consisting of:

a spin-polarized Heusler alloy; a spin-polarized Colossal magnetoresistance material; and $CrO_2$.

5. The apparatus of claim 4, wherein said spin-polarized Heusler alloy is selected from the group consisting of:

$Co_2FeAl_{0.5}Si_{0.5}$; NiMnSb; $Co_2MnSi$; $Co_2MnGe$; $Co_2MnSn$; $Co_2FeAl$; $Co_2FeSi$ and $Co_2FeS$.

6. The apparatus of claim 1, wherein said conductive ferromagnetic material comprises a geometrical region ($L_{1x}$, $L_{1y}$) that is less than a minimum geometrical region ($L_{critical\ x}$, $L_{critical\ y}$) required for generation of ultra-high frequency phonons inside said conductive ferromagnetic material.

7. The apparatus of claim 1, wherein said tunnel junction is selected from the group consisting of:

AlO; $Al_2O_3$; and MgO.

8. The apparatus of claim 1, wherein said ferromagnetic dielectric material including said magnetic phonon-gain medium further comprises:

a ferromagnetic dielectric material having temperature Curie less than the temperature Curie of said conductive ferromagnetic material.

9. The apparatus of claim 1, wherein said ferromagnetic dielectric material comprises a geometrical region ($L_{2x}$, $La_{2y}$) that is greater than a minimum geometrical region ($L_{critical\ x}$, $L_{critical\ y}$) required for generation of ultra-high frequency phonons inside said ferromagnetic dielectric material.

10. The apparatus of claim 1 further comprising:

an ultra-high frequency sound waveguide coupled to said ferromagnetic dielectric material; said ultra-high frequency sound waveguide configured to output ultra-high frequency sound waves.

11. A method for generating of an ultra-high frequency sound by using an apparatus comprising a spin injector, a tunnel junction, a conductive ferromagnetic material including a magnon gain medium, and a ferromagnetic dielectric material including a magnetic phonon-gain medium; said method comprising:

(A) applying an external bias voltage to said spin injector to inject minority electrons into said conductive ferromagnetic material from said spin injector via said tunnel junction; wherein said minority electrons generate non-equilibrium magnons inside said magnon gain medium of said conductive ferromagnetic material; and wherein said non-equilibrium magnons propagate into said ferromagnetic dielectric material ferromagnetic dielectric material and generate inside said magnetic phonon-gain medium ultra-high frequency phonons;

and (B) generating said ultra-high frequency sound by outputting said ultra-high frequency phonons from said ferromagnetic dielectric material.

12. The method of claim 11, wherein said step (A) further comprises:

(A1) selecting said spin injector from the group consisting of:

a half-metal having lower sub-band with spin down oriented opposite to the direction of magnetization of said conductive ferromagnetic material; and a half-metal having lower sub-band with spin down oriented opposite to the direction of magnetization of said conductive ferromagnetic material by applying an external force.

13. The method of claim 11, wherein said step (A) further comprises:

(A2) selecting said conductive ferromagnetic material including said magnon gain medium from the group consisting of:

a ferromagnetic semiconductor; a dilute magnetic semiconductor (DMS); a half-metallic ferromagnet (HMF); and a ferromagnetic conductor, with a gap in the density of states of the minority electrons around the Fermi level of said conductive ferromagnetic material.

14. The method of claim 13, wherein said step (A2) further comprises:

(A2, 1) selecting said half-metallic ferromagnet (HMF) from the group consisting of:

a spin-polarized Heusler alloy; a spin-polarized Colossal magnetoresistance material; and $CrO_2$.

15. The method of claim 14, wherein said step (A2, 1) further comprises:

(A2, 1, 1) selecting said spin-polarized Heusler alloy from the group consisting of:

$Co_2FeAl_{0.5}Si_{0.5}$; NiMnSb; $Co_2MnSi$; $Co_2MnGe$; $Co_2MnSn$; $Co_2FeAl$; $Co_2FeSi$; and $Co_2FeS$.

16. The method of claim 11, wherein said step (A) further comprises:

(A3) selecting said conductive ferromagnetic material to comprise a geometrical region ($L_{1x}$, $L_{1y}$) that is less than a minimum geometrical region ($L_{critical\ x}$, $L_{critical\ y}$) required for generation of ultra-high frequency phonons inside said conductive ferromagnetic material.

17. The method of claim 11, wherein said step (A) further comprises:

(A4) selecting said tunnel junction from the group consisting of:

AlO; $Al_2O_3$; and MgO.

18. The method of claim 11, wherein said step (A) further comprises:

(A5) selecting said ferromagnetic dielectric material to have temperature Curie less than the temperature Curie of said conductive ferromagnetic material.

19. The method of claim 11, wherein said step (A) further comprises:

(A6) selecting said ferromagnetic dielectric material to comprise a geometrical region ($L_{2x}$, $L_{2y}$) that is greater than a minimum geometrical region ($L_{critical\ x}$, $L_{critical\ y}$) required for generation of ultra-high frequency phonons inside said ferromagnetic dielectric material.

20. The method of claim 11, said apparatus further comprises an ultra-high frequency sound waveguide coupled to said ferromagnetic dielectric material; said step (B) further comprises:

(B1) outputting ultra-high frequency sound waves via said ultra-high frequency sound waveguide coupled to said ferromagnetic dielectric material.

* * * * *